US005782218A

United States Patent [19]

Akinori

[11] Patent Number: 5,782,218

[45] Date of Patent: Jul. 21, 1998

[54] EVAPORATED FUEL TREATMENT DEVICE OF AN ENGINE

[75] Inventor: Osanai Akinori, Susono, Japan

[73] Assignee: Toyota Jidosha Kabushiki Kaisha, Aichi, Japan

[21] Appl. No.: 922,529

[22] Filed: Sep. 3, 1997

[30] Foreign Application Priority Data

Sep. 4, 1996 [JP] Japan ..... 8-234449

[51] Int. Cl.[6] ..... F02B 77/00; F02M 33/02

[52] U.S. Cl. ..... 123/198 D; 123/520; 123/179.17

[58] Field of Search ..... 123/198 D, 520, 123/179.17, 519, 518, 516, 521

[56] References Cited

U.S. PATENT DOCUMENTS

| | | | |
|---|---|---|---|
| 5,203,870 | 4/1993 | Kayanuma | 123/198 D |
| 5,216,997 | 6/1993 | Osanai | 123/198 D |
| 5,323,751 | 6/1994 | Osanai | 123/198 D |
| 5,373,823 | 12/1994 | Kuroda | 123/198 D |
| 5,501,199 | 3/1996 | Yoneyama | 123/520 |
| 5,609,142 | 3/1997 | Osanai | 123/520 |
| 5,634,452 | 6/1997 | Hara | 123/520 |
| 5,638,795 | 6/1997 | Hara | 123/520 |
| 5,676,118 | 10/1997 | Saito | 123/520 |

FOREIGN PATENT DOCUMENTS

| | | |
|---|---|---|
| 60-162262 | 10/1985 | Japan . |
| 63-189665 | 8/1988 | Japan . |
| 4370359 | 12/1992 | Japan . |
| A579410 | 3/1993 | Japan . |
| 6241124 | 8/1994 | Japan . |

*Primary Examiner*—Carl S. Miller
*Attorney, Agent, or Firm*—Kenyon & Kenyon

[57] ABSTRACT

An evaporated fuel treatment device comprising a purge control valve for controlling an amount of fuel vapor fed into the intake passage from a charcoal canister. When the engine stalls, it is judged if it was because of the purge action of the fuel vapor. When it is judged that the engine stalled due to the purge action, the purge action is restarted from a purge rate of zero when the engine is restarted.

13 Claims, 13 Drawing Sheets

EVAPORATED FUEL TREATMENT DEVICE OF AN ENGINE

BACKGROUND OF THE INVENTION

1. Field of the Invention

The present invention relates to an evaporated fuel treatment device of an engine.

2. Description of the Related Art

In an internal combustion engine designed to have the evaporated fuel produced in the fuel tank etc. adsorbed once by activated carbon in a canister and to have the evaporated fuel adsorbed by the activated carbon purged in the engine intake passage, the engine will stall if the air-fuel mixture supplied into the engine cylinders becomes too rich due to the purge action of the evaporated fuel. Therefore, to prevent such engine stalling from occurring, there is known an internal combustion engine designed so that the evaporated fuel is purged into just one intake pipe of the intake pipes connected to the cylinders of a multicylinder internal combustion engine (see Japanese Unexamined Patent Publication (Kokai) No. 6-241124). In this internal combustion engine, even if one cylinder fails to fire due to the purge action of the evaporated fuel, the remaining cylinders will be operating normally, so it is possible to prevent engine stalling.

In this way, various internal combustion engines have been proposed which prevent engine stalling even with purging of fuel vapor. The present invention, however, is directed to the control of the purge action after engine stalling has occurred and therefore differs from these conventional internal combustion engines. That is, the present invention assumes the occurrence of engine stalling and takes up the issue of how to prevent engine stalling when restarting the engine after stalling.

SUMMARY OF THE INVENTION

An object of the present invention is to provide an evaporated fuel treatment device capable of preventing an engine from stalling again when the engine is restarted after having once stalled.

According to the present invention, there is provided an evaporated fuel treatment device for an engine provided with an intake passage, comprising a purge control valve for controlling an amount of purge of fuel vapor to be purged to the intake passage; purge control means for controlling the amount of opening of the purge control valve so that a purge rate of fuel vapor to the intake passage becomes a target purge rate determined by the operating state of the engine; and judging means for judging if the engine has stalled due to the purge action of the fuel vapor, the purge control means restarting the purge action by a purge rate lower than the purge rate at the time when the engine stalled when restarting the engine after it is judged that the engine has stalled due to the purge action of fuel vapor.

BRIEF DESCRIPTION OF THE DRAWINGS

These and other objects and features of the present invention will become more apparent from the following description of the preferred embodiments given with reference to the attached drawings, in which.

DESCRIPTION OF THE PREFERRED EMBODIMENTS

Figure 1:
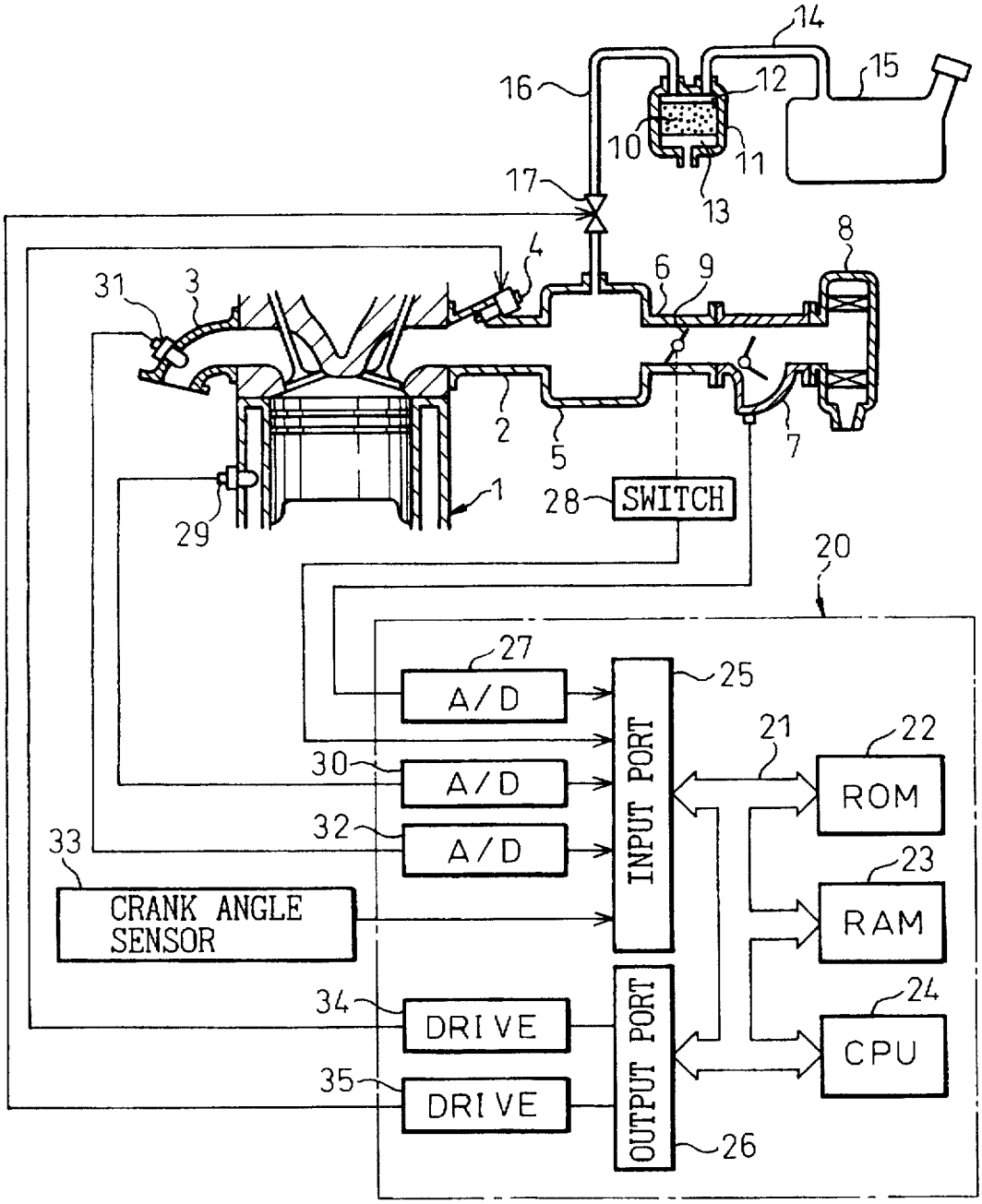
FIG. 1 is an overall view of an internal combustion engine.

Referring to FIG. 1, 1 is an engine body, 2 an intake pipe, 3 an exhaust manifold, and 4 a fuel injector attached to each of the intake pipes 2. Each intake pipe 2 is connected to a common surge tank 5. The surge tank 5 is connected through an intake duct 6 and an air flow meter 7 to an air cleaner 8. In the intake duct 6 is arranged a throttle valve 9. Further, as shown in FIG. 1, the internal combustion engine has disposed in it a canister 11 containing activated carbon 10. The canister 11 has a fuel vapor chamber 12 and an atmospheric chamber 13 on the two sides of the activated carbon 10. The fuel vapor chamber 12 on the one hand is connected through a conduit 14 to a fuel tank 15 and on the other hand through a conduit 16 to the inside of the surge tank 5. In the conduit 16 is disposed a purge control valve 17 which is controlled by output signals from an electronic control unit 20. The fuel vapor which is generated in the fuel tank 15 is sent through the conduit 14 into the canister 11 where it is absorbed by the activated carbon 10. When the purge control valve 17 opens, the air is sent from the atmospheric chamber 13 through the activated carbon 10 into the conduit 16. When the air passes through the activated carbon 10, the fuel vapor which is absorbed in the activated carbon 10 is released from the activated carbon 10 therefore air containing the fuel vapor is purged through the conduit 16 to the inside of the surge tank 5.

The electronic control unit 20 is comprised of a digital computer and is provided with a read only memory (ROM) 22, a random access memory (RAM) 23, a microprocessor (CPU) 24, an input port 25, and an output port 26 connected to each other through a bidirectional bus 21. The air flow meter 7 generates an output voltage proportional to the amount of the intake air. This output voltage is input through the AD converter 27 to the input port 25. The throttle valve 9 has attached to it a throttle switch 28 which becomes on when the throttle valve 9 is at the idle open position. The output signal of the throttle switch 28 is input to the input port 25. The engine body 1 has attached to it a water temperature sensor 29 for generating an output voltage proportional to the coolant water temperature of the engine. The output voltage of the water temperature sensor 29 is input through the AD converter 30 to the input port 25. The exhaust manifold 3 has an air-fuel ratio sensor 31 attached to it. The output signal of the air-fuel ratio sensor 31 is input through the AD converter 32 to the input port 25. Further, the input port 25 has connected to it a crank angle sensor 33 generating an output pulse every time the crankshaft rotates by for example 30 degrees. In the CPU 24, the engine speed is calculated based on this output pulse. On the other hand, the output port 26 is connected through the corresponding drive circuits 34 and 35 to the fuel injectors 4 and the purge control valve 17.

In the internal combustion engine shown in FIG. 1, the fuel injection time TAU is calculated based fundamentally on the following equation:

$$TAU=TP\cdot\{K+FAF-FPG\}$$

where, the coefficients show the following:

TP: basic fuel injection time

K: correction coefficient

FAF: feedback correction coefficient

FPG: purge A/F correction coefficient

The basic fuel injection time TP is the experimentally found injection time required for making the air-fuel ratio the target air-fuel ratio. The basic fuel injection time TP is stored in advance in the ROM 22 as a function of the engine load Q/N (amount of intake air Q/engine speed N) and the engine speed N.

The correction coefficient K expresses the engine warmup increase coefficient and the acceleration increase coefficient all together. When no upward correction is needed, K is made 0.

The purge A/F correction coefficient FPG is for correction of the amount of injection when the purge has been performed. The period from when the engine operation is started to when the purge is started is FPG=0.

The feedback correction coefficient FAF is for controlling the air-fuel ratio to the target air-fuel ratio based on the output signal of the air-fuel ratio sensor 31. As the target air-fuel ratio, any air-fuel ratio may be used, but in the embodiment shown in FIG. 1, the target air-fuel ratio is made the stoichiometric air-fuel ratio, therefore the explanation will be made of the case of making the target air-fuel ratio the stoichiometric air-fuel ratio hereafter. Note that when the target air-fuel ratio is the stoichiometric air-fuel ratio, as the air-fuel ratio sensor 31, a sensor whose output voltage changes in accordance with the concentration of oxygen in the exhaust gas is used, therefore hereinafter the air-fuel ratio sensor 31 will be referred to as an $O_2$ sensor. This $O_2$ sensor 31 generates an output voltage of about 0.9 V when the air-fuel ratio is rich and generates an output voltage of about 0.1 V when the air-fuel ratio is lean. First, an explanation will be made of the control of the feedback correction coefficient FAF performed based on the output signal of this $O_2$ sensor 31.

Figure 2:
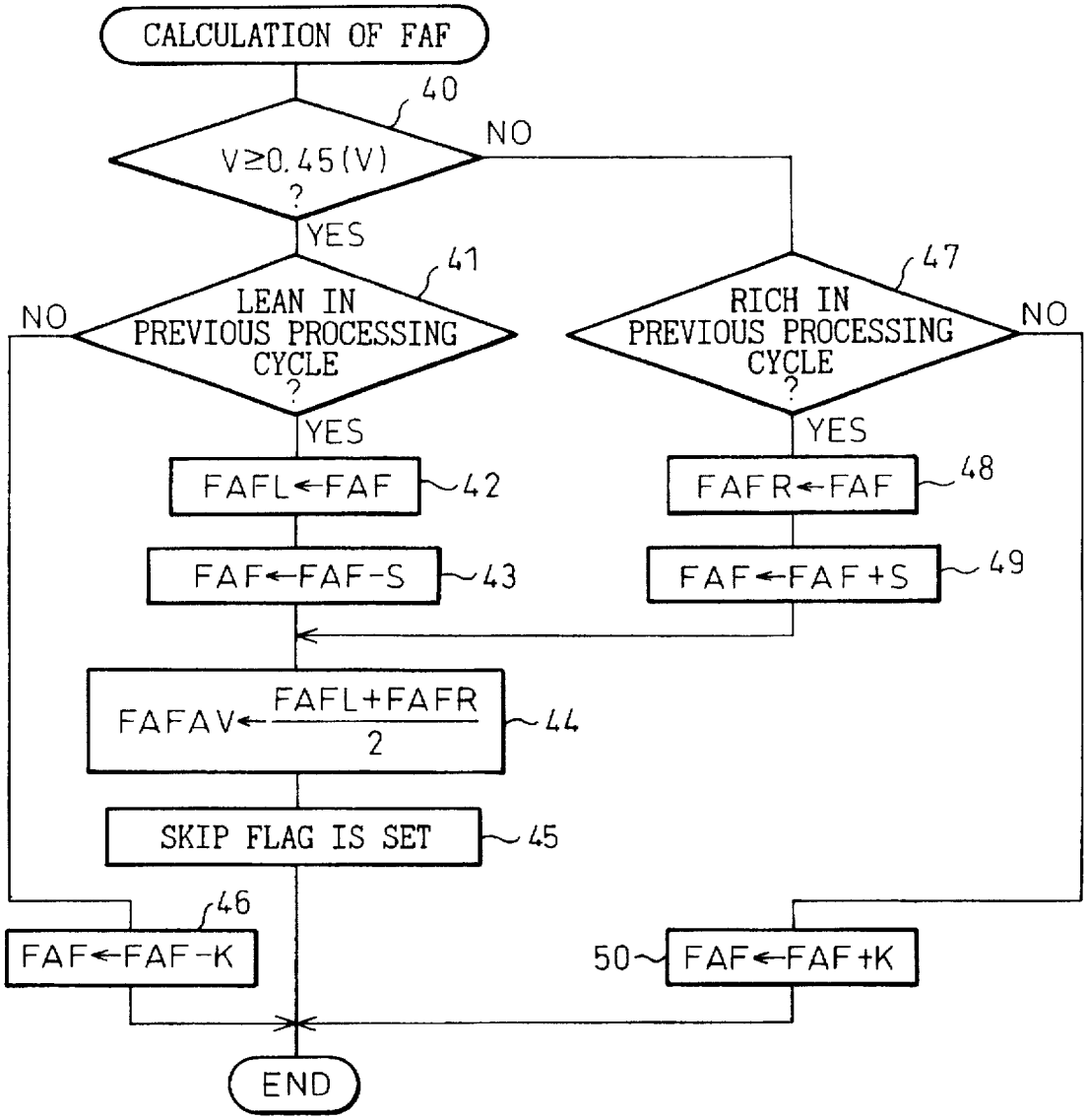
FIG. 2 is a flow chart of a routine for calculating an air-fuel ratio feedback correction coefficient FAF.

FIG. 2 shows the routine for calculation of the feedback correction coefficient FAF. This routine is executed for example within a main routine.

Figure 3:
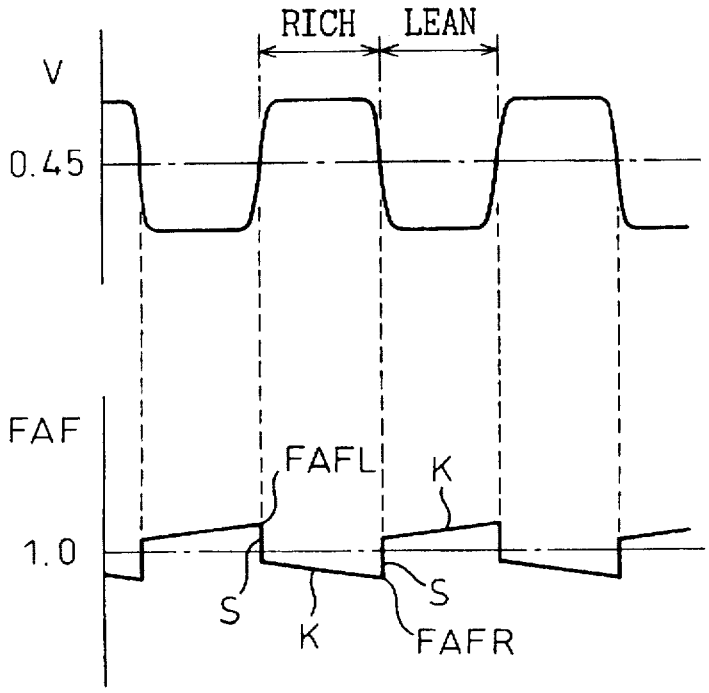
FIG. 3 is a view of the changes in the air-fuel ratio feedback correction coefficient FAF.

Referring to FIG. 2, first, at step 40, it is judged whether the output voltage of the $O_2$ sensor 31 is higher than 0.45 V or not, that is, whether the air-fuel ratio is rich or not. When $V \geqq 0.45$ V, that is, when the air-fuel ratio is rich, the routine proceeds to step 41, where it is judged if the air-fuel ratio was lean at the time of the previous processing cycle or not. When it was lean at the time of the previous processing cycle, that is, when it has changed from lean to rich, the routine proceeds to step 42, where the feedback control coefficient FAF is made FAFL and the routine proceeds to step 43. At step 43, a skip value S is subtracted from the feedback control coefficient FAF, therefore, as shown in FIG. 3, the feedback control coefficient FAF is rapidly reduced by the skip value S. Next, at step 44, the average value FAFAV of the FAFL and FAFR is calculated. Next, at step 45, the skip flag is set. On the other hand, when it is judged at step 41 that the air-fuel ratio was rich at the time of the previous processing cycle, the routine proceeds to step 46, where the integral value K (K<<S) is subtracted from the feedback control coefficient FAF. Therefore, as shown in FIG. 2, the feedback control coefficient FAF is gradually reduced.

On the other hand, when it is judged at step 40 that $V<0.45$ V, that is, when the air-fuel ratio is lean, the routine proceeds to step 47, where it is judged if the air-fuel ratio was rich at the time of the previous processing cycle. When it was rich at the time of the previous processing cycle, that is, when it changed from rich to lean, the routine proceeds to step 48, where the feedback control coefficient FAF is made FAFR and the routine proceeds to step 49. At step 49, the skip value S is added to the feedback control coefficient FAF, therefore, as shown in FIG. 3, the feedback control coefficient FAF is rapidly increased by exactly the skip value S. Next, when it was judged at step 44 that the air-fuel ratio was lean at the time of the previous processing cycle, the routine proceeds to step 50, where the integral value K is added to the feedback control coefficient FAF. Therefore, as shown in FIG. 3, the feedback control coefficient FAF is gradually increased.

When the air-fuel ratio becomes rich and FAF becomes smaller, the fuel injection time TAU becomes shorter, while when the air-fuel ratio becomes lean and the FAF increases, the fuel injection time TAU becomes longer, so the air-fuel ratio is maintained at the stoichiometric air-fuel ratio. Note that when the purge action is not performed, as shown in FIG. 3, the feedback control coefficient FAF fluctuates about 1.0. Further, as will be understood from FIG. 3, the average value FAFAV calculated at step 44 shows the average value of the feedback control coefficient FAF.

Figure 4A:
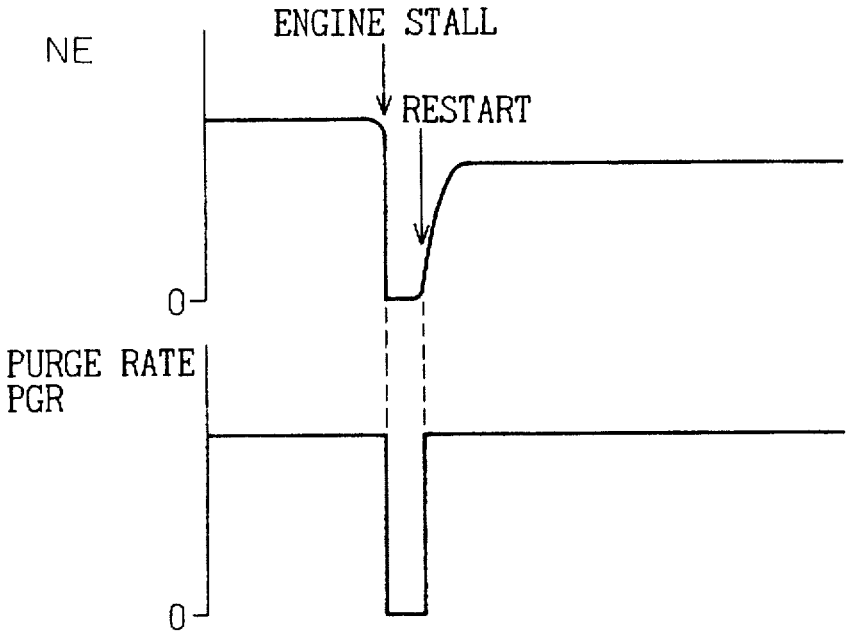
FIGS. 4A and 4B are time charts of changes in the purge rate PGR etc.
Figure 4B:
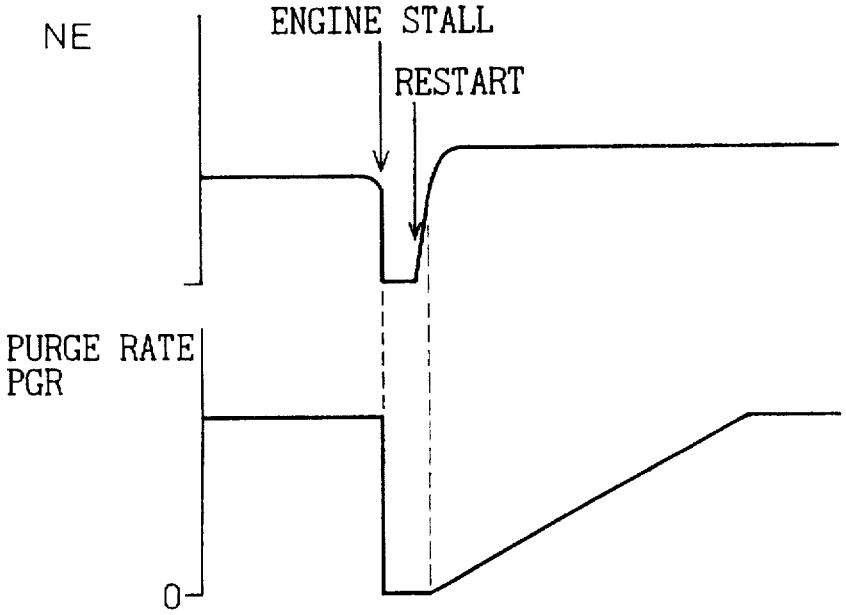

Next, an explanation will be made of the purge control according to the present invention with reference to FIGS. 4A and 4B and FIG. 5; FIGS. 4A and 4B show the relationship between the vehicle speed NE and the purge rate PGR of the fuel vapor to be purged in the intake passage. FIG. 4A shows the case where the engine has stalled due to a reason other than the purge action of the fuel vapor and the engine is then restarted. In this case, as shown in FIG. 4A, the purge rate PGR is made zero once when the engine stalls, that is, the purge action is stopped, then, when the engine is restarted, the purge action is restarted by the purge rate PGR of the time when the engine stalled.

On the other hand, FIG. 4B shows the case where the engine has stalled due to the purge action of the fuel vapor and the engine is then restarted. In this case as well, as shown in FIG. 4B, the purge rate PGR is made zero once when the engine stalls, that is, the purge action is stopped, then, when the engine is restarted, the purge action is started. In this case, however, the purge action is restarted by a purge rate lower than the purge rate PGR of the time when the engine stalled, that is, in the example shown in FIG. 4B, the purge rate PGR of zero. Next, the purge rate PGR is gradually increased. When the predetermined maximum purge rate is reached, the purge rate PGR is maintained at that maximum purge rate.

Engine stalling occurs due to the purge action of fuel vapor when the concentration of the fuel vapor becomes high. The concentration of the fuel vapor becomes high for example when the temperature of the fuel tank 15 becomes high and the purge action is stopped for a while. That is, if the purge action is stopped when the temperature of the fuel tank 15 is high, a large amount of evaporated fuel will be generated in the fuel tank 15 and a large amount of evaporated fuel will be adsorbed by the activated carbon 10 in the canister 11. If the purge action is restarted in this state, the concentration of the fuel vapor which is purged will become high. If the engine is operating at a low load with a small amount of intake air at this time, the air-fuel mixture supplied into the engine cylinders will become over rich and the engine will stall.

If the engine stalls and then is restarted, the concentration of the fuel vapor to be purged will become high. Therefore, the purge rate PGR is made to gradually increase from zero as shown in FIG. 4B so that the engine will not stall again after it is restarted. While the purge rate PGR is being gradually increased, the evaporated fuel in the fuel tank 15 and the canister 11 will decrease and therefore the engine will not stall even when the purge rate PGR after the restart of the purge action returns to the purge rate PGR at the time when the engine stalled.

Figure 5:
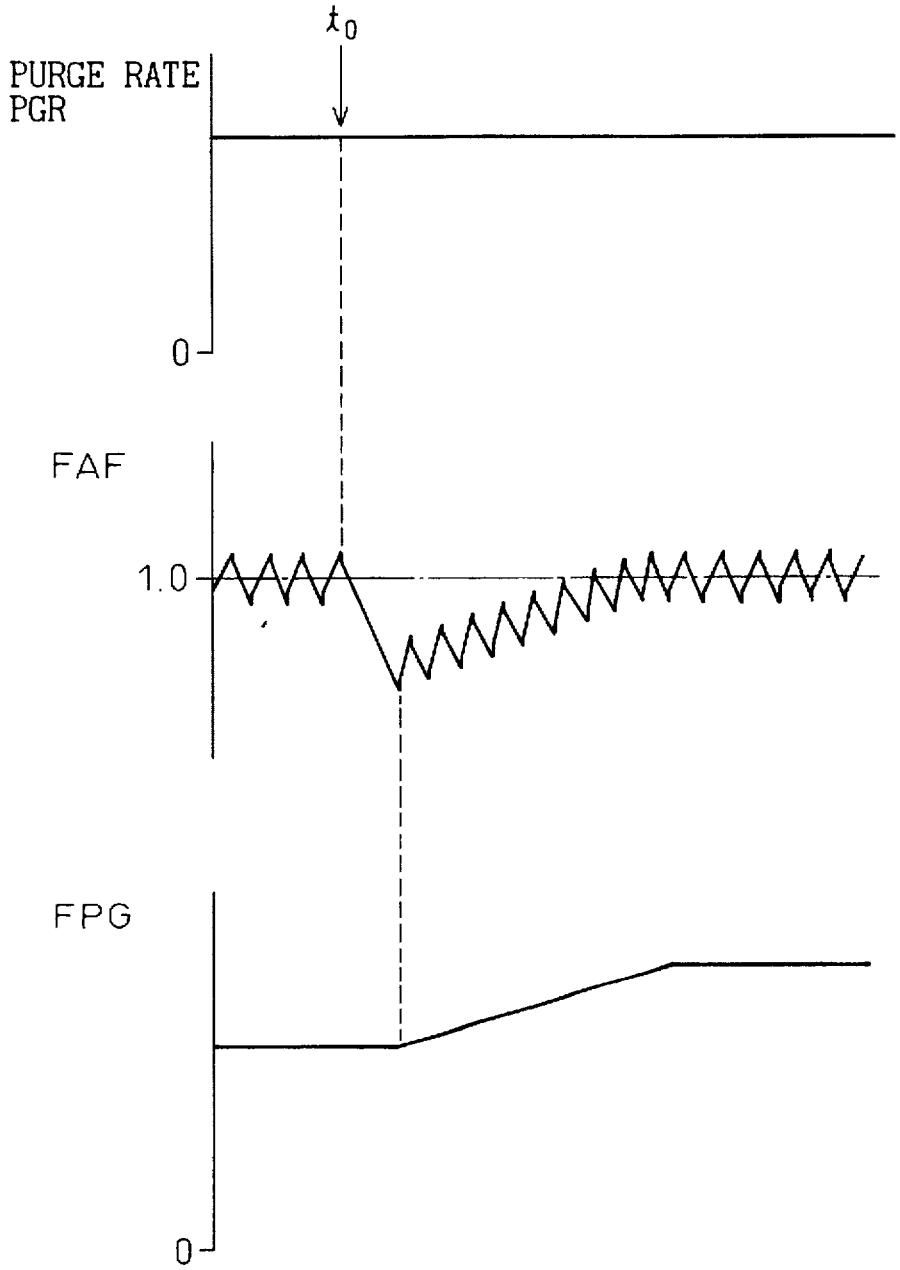
FIG. 5 is a time chart of changes in the purge rate PGR etc.

FIG. 5 shows the changes in the feedback correction coefficient FAF and the purge A/F correction coefficient FPG when the concentration of the fuel vapor to be purged at the time $t_0$ becomes high and as a result the air-fuel ratio becomes rich. If the air-fuel ratio becomes rich, then as shown in FIG. 5, the feedback correction coefficient FAF becomes small. Next, when the feedback correction coefficient FAF starts to rise, that is, when the air-fuel ratio is held at the stoichiometric air-fuel ratio, the purge A/F correction coefficient FPG is gradually increased and along with this FAF is gradually returned to 1.0. Next, when FAF starts to fluctuate around 1.0, the purge A/F correction coefficient FPG is maintained substantially constant. The value of the purge A/F correction coefficient FPG at this time expresses the amount of fluctuation of the air-fuel ratio by the purge action of the fuel vapor.

If this purge A/F correction coefficient FPG is used to correct the fuel injection time TAU at the time when the purge action is being performed, the air-fuel ratio will not fluctuate so long as the concentration of the fuel vapor to be purged does not change sharply. Therefore, in this embodiment of the present invention, when the concentration of the fuel vapor to be purged does not change that much even if the engine stalls and the purge action is stopped once, the purge action is restarted by the purge rate PGR at the time when the engine stalled as shown in FIG. 4A.

An engine stalls when the concentration of the fuel vapor to be purged has risen when the amount of intake air is small, that is, when the engine load is low, in particular during idling. When the amount of intake air is large even when the concentration of the fuel vapor to be purged becomes high, the air-fuel mixture supplied into the engine cylinders will not become over rich enough to cause the engine to stall. Therefore, at this time, if the engine stalls, it is probably due to a mistaken operation of the clutch. Accordingly, in the first embodiment of the present invention, it is judged that the engine has stalled due to the purge action of the fuel vapor when the engine stalls at the time of idling.

Next, an explanation will be made of a routine for control of the purge with reference to FIG. 6 to FIG. 8. Note that this routine is executed by interruption every predetermined time.

Figure 6:
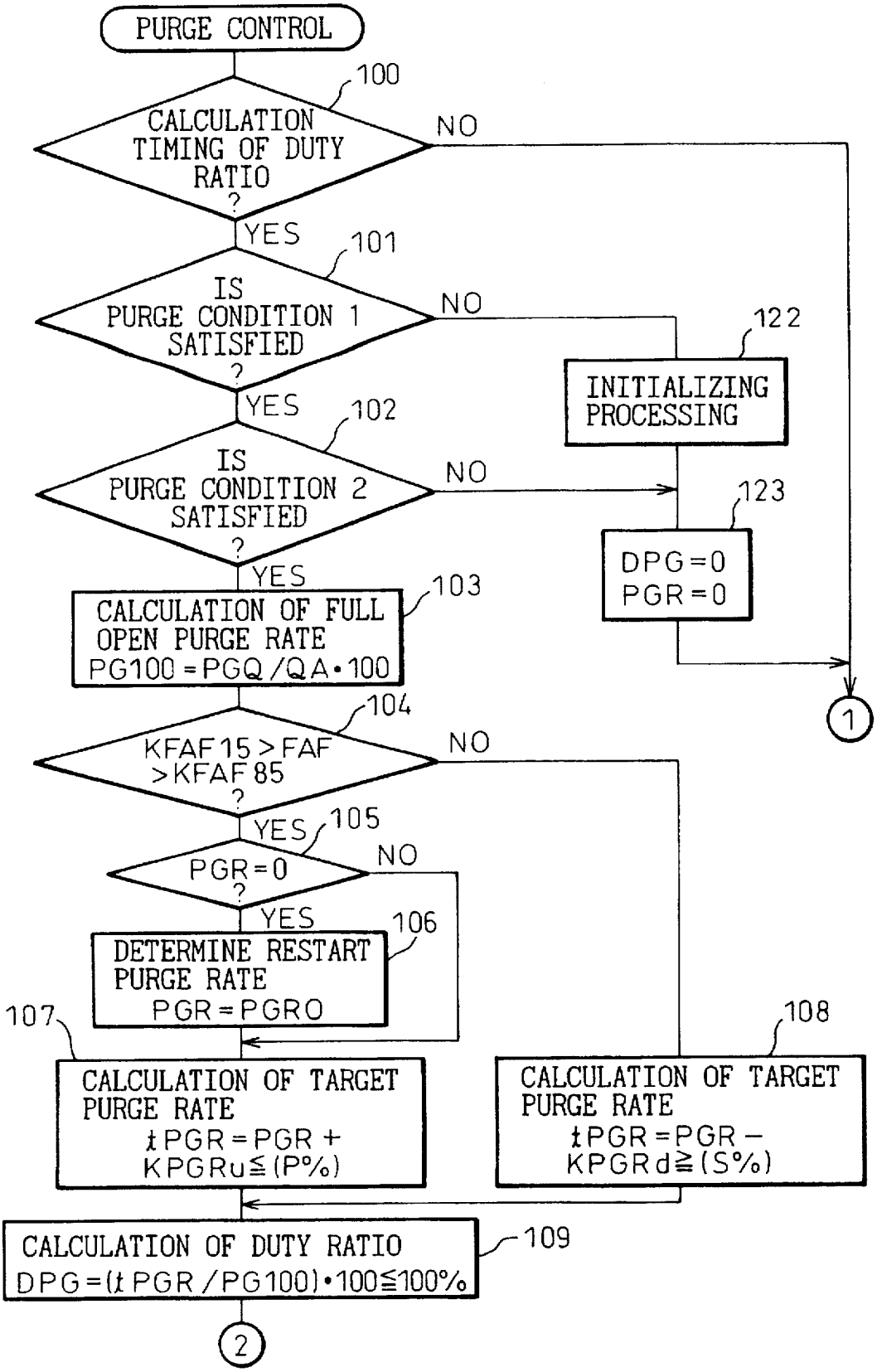
FIGS. 6 and 7 are flow charts of a first embodiment for the purge control.
Figure 7:
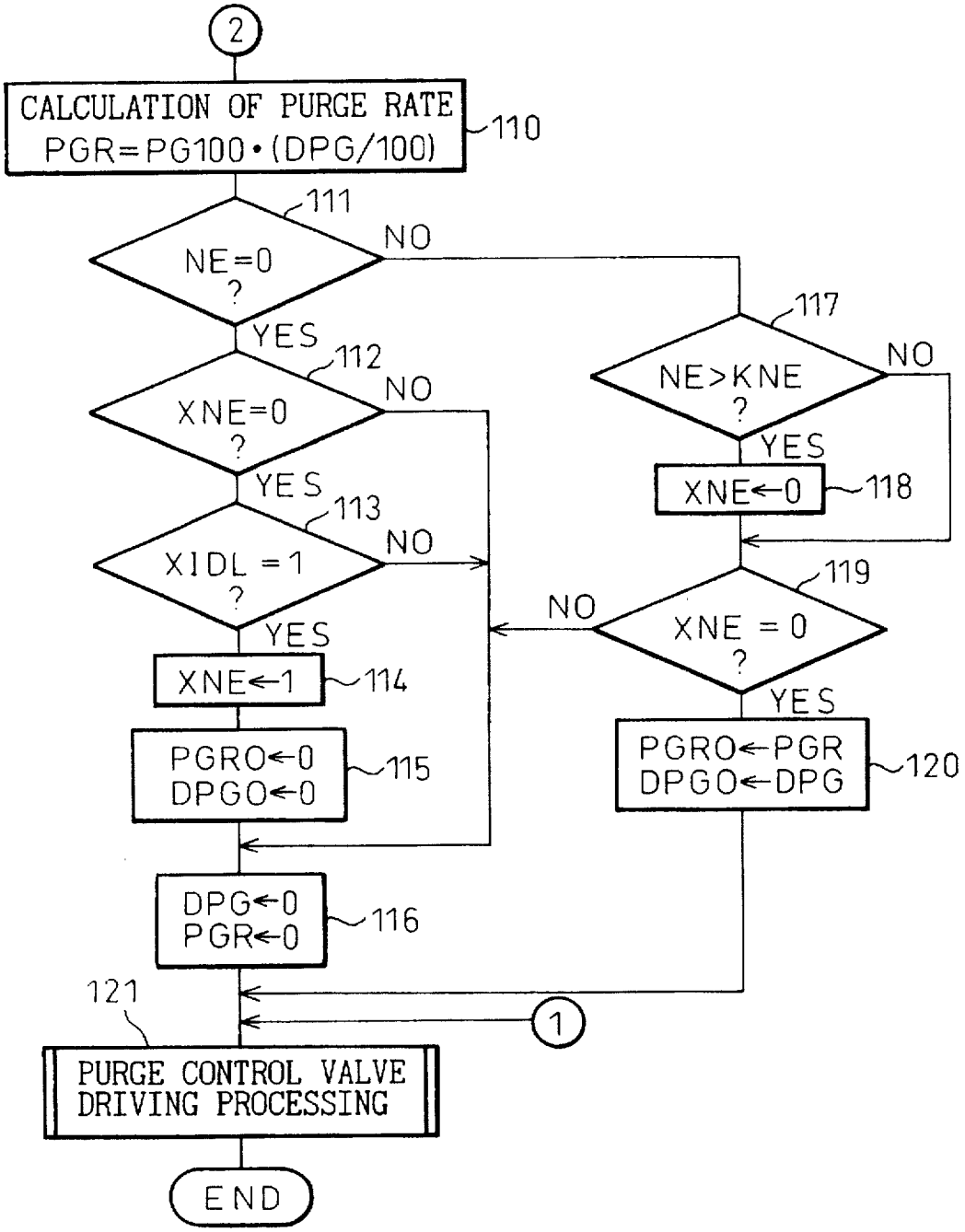

Referring to FIG. 6 and FIG. 7, first, at step 100, it is judged whether the time is the time of calculation of the duty ratio of the drive pulse of the purge control valve 17 or not. In the embodiment according to the present invention, the duty ratio is calculated every 100 msec. When not the time for calculation of the duty ratio, the routine jumps to step 121, where the processing for driving the purge control valve 17 is executed. As opposed to this, when it is the time for calculation of the duty ratio, the routine proceeds to step 101, where it is judged if the purge condition 1 is satisfied or not, for example, if the engine warmup has been completed or not. When the purge condition 1 is not satisfied, the routine proceeds to step 122, where the initialization processing is performed, then at step 123, the duty ratio DPG and the purge rate PGR are made zero. As opposed to this, when the purge condition 1 is satisfied, the routine proceeds to step 102, where it is judged if the purge condition 2 is satisfied or not, for example, whether feedback control of the air-fuel ratio is being performed or not. When the purge condition 2 is not satisfied, the routine proceeds to step 123, while when the purge condition 2 is satisfied, the routine proceeds to step 103.

At step 103, the ratio between the full open purge amount PGQ and the amount QA of intake air, that is, the full open purge rate PG100(=(PGQ/QA)·100) is calculated. Here, the full open purge amount PGQ shows the amount of purge when the purge control valve 17 is fully open. The full open purge rate PG100 is a function of for example the engine load Q/N (amount QA of intake air/engine speed N) and the engine speed N and is found in advance by experiments. It is stored in advance in the ROM 22 in the form of a map as shown in the following table.

TABLE

| | Q/N | | | | | | | | | | |
|---|---|---|---|---|---|---|---|---|---|---|---|
| N | 0.15 | 0.30 | 0.45 | 0.60 | 0.75 | 0.90 | 1.05 | 1.20 | 1.35 | 1.50 | 1.65 |
| 400 | 25.6 | 25.6 | 21.6 | 15.0 | 11.4 | 8.6 | 6.3 | 4.3 | 2.8 | 0.8 | 0 |
| 800 | 25.6 | 16.3 | 10.8 | 7.5 | 5.7 | 4.3 | 3.1 | 2.1 | 1.4 | 0.4 | 0 |
| 1600 | 16.6 | 8.3 | 5.5 | 3.7 | 2.8 | 2.1 | 1.5 | 1.2 | 0.9 | 0.3 | 0 |
| 2400 | 10.6 | 5.3 | 3.5 | 2.4 | 1.8 | 1.4 | 1.1 | 0.8 | 0.6 | 0.3 | 0.1 |
| 3200 | 7.8 | 3.9 | 2.5 | 1.8 | 1.4 | 1.1 | 0.9 | 0.6 | 0.5 | 0.4 | 0.2 |
| 4000 | 6.4 | 3.2 | 2.1 | 1.5 | 1.2 | 0.9 | 0.7 | 0.6 | 0.4 | 0.4 | 0.3 |

The lower the engine load Q/N becomes, the larger the full open purge amount PGQ with respect to the amount QA of intake air becomes, so as shown in Table 1, the full open purge rate PG100 becomes larger the lower the engine load Q/N becomes and the full open purge amount PGQ with respect to the amount QA of intake air becomes larger the lower the engine speed N becomes, so as shown in Table 1, the full open purge rate PG100 becomes larger the lower the engine speed N.

Next, at step 104, it is judged if the feedback control coefficient FAF is between the upper limit value KFAF15 (=1.15) and the lower limit value KFAF85(=0.85) or not. When KFAF15>FAF>KFAF85, that is, when the air-fuel ratio is being feedback controlled to the stoichiometric air-fuel ratio, the routine proceeds to step 105, where it is judged whether the purge rate PGR is zero or not. That is, when the purge action is being performed, PGR>0, so at this time the routine jumps to step 107. As opposed to this, when the purge action is not started, the routine proceeds to step 106, where the purge rate PGRO is made the restart purge rate PGR. When the purge condition 1 and the purge condition 2 are satisfied for the first time after the engine has started being operated, the purge rate PGR0 is made zero by the initialization processing (step 122), so at this time PGR=0. As opposed to this, when the purge action is stopped once and then the purge control is restarted, in principle the purge rate PGR0 just before the purge control was stopped is used as the restart purge rate PGR.

At step 107, the target purge rate tPGR(=PGR+KPRGu) is calculated by adding a constant value KPGRu to the purge rate PGR. That is, when KFAF15>FAF>KFAF85, it is understood, the target purge rate tPGR is gradually increased every 100 msec. Note that an upper limit purge rate P (P is for example 6%) is set for this target purge rate tPGR, therefore the target purge rate tPGR can only rise up to this upper limit purge rate P. Next, the routine proceeds to step 109.

On the other hand, when it is judged at step 104 that FAF≧KFAF15 or FAF≦KFAF85, the routine proceeds to step 108, where the constant value KPGRd is subtracted from the purge rate PGR to calculate the target purge rate tPGR(=PGR−KPGRd). That is, when the air-fuel ratio cannot be maintained at the stoichiometric air-fuel ratio due to the purge action of the fuel vapor, the target purge rate tPGR is reduced. Note that a lower limit value S (S=0%) is set for the target purge rate tPGR. Next, the routine proceeds to step 109.

At step 109, the target purge rate tPGR is divided by the full open purge rate PG100 to calculate the duty ratio DPG(=(tPGR/PG100)·100) of the drive pulse of the purge control valve 17. Therefore, the duty ratio DPG of the drive pulse of the purge control valve 17, that is, the amount of opening of the purge control valve 17, is controlled in accordance with the ratio of the target purge rate tTPG to the full open purge rate PG100. If the amount of opening of the purge control valve 17 is controlled in accordance with the ratio of the target purge rate tTPG to the full open purge rate PG100 in this way, no matter what purge rate the target purge rate tTPG is, regardless of the engine operating state, the actual purge rate will be maintained at the target purge rate.

Suppose for example that the target purge rate tTPG is 2 percent and the full open purge rate PG100 at the current operating state is 10 percent. The duty ratio DPG of the drive pulse will become 20 percent and the actual purge rate at this time will become 2 percent. Next, supposing that the operating state changes and the full open purge rate PG100 at the changed operating state becomes 5 percent, the duty ratio DPG of the duty ratio will become 40 percent and the actual purge ratio at this time will become 2 percent. That is, if the target purge rate tTPG is 2 percent, the actual purge rate will become 2 percent regardless of the engine operating state. If the target purge rate tTPG changes and becomes 4 percent, the actual purge rate will be maintained at 4 percent regardless of the engine operating state.

Next, at step 110, the full open rate PG100 is multiplied by the duty ratio DPG to calculate the actual purge rate PGR (=PG100·(DPG/100)). That is, as explained above, the duty ratio DPG is expressed by (tPGR/PG100)·100. In this case, when the target purge rate tPGR becomes larger than the full open purge rate PG100, the duty ratio DPG would become more than 100 percent. The duty ratio DPG, however, cannot become more than 100 percent. At this time, the duty ratio DPG is made 100 percent, therefore the actual purge rate PGR becomes smaller than the target purge rate tPGR. Accordingly, the actual purge rate PGR is expressed by PG100·(DPG/100) as explained above.

Next, from step 111 to step 120, the purge control for when the engine stalls due to the purge action of the fuel vapor is performed. That is, at step 111, it is judged if the engine speed NE is zero or not, that is, if the engine has stalled or not. When NE=0, that is, when the engine has stalled, the routine proceeds to step 112, where it is judged if an engine stall flag XNE showing that the engine has stalled due to the purge action is reset (XNE=0) or not. When the routine proceeds to step 112 for the first time after the engine has stalled, the engine stall flag XNE is reset, so the routine proceeds to 113.

At step 106, it is judged if the idling flag XIDL, which is set when the engine operating state is an idling state, has been set (XIDL=1) or not. When the idling flag XIDL is reset, that is, when the engine is not idling, when the engine has stalled, the routine jumps to step 116, where the duty ratio DPG is made zero and the purge rate PGR is made zero. Therefore, the purge action of the fuel vapor is stopped.

On the other hand, when it is judged at step 113 that the idling flag XIDL has been set, that is, when the engine stalls while it is idling, the routine proceeds to step 114, where the engine stall flag XNE is set (XNE=1), then the routine proceeds to step 115, where PGR0 and DPG0 are made zero. Next, the routine proceeds to step 116. Once the engine stall flag XNE is set, the routine jumps from step 112 to step 116.

If the engine is restarted after it has stalled, since the purge action is stopped, that is, since it is judged at step 105 that PGR=0, the routine proceeds to step 106, where PGR0 is made the restart purge rate PGR. If the engine stalls during engine idling, PGR0=0 as mentioned above, so the restart purge rate PGR is made zero at that time.

On the other hand, if the engine is restarted, the routine proceeds from step 111 to step 117 where it is judged if the engine speed NE has become higher than a set value KNE, for example, 500 rpm, or not. When NE≦KNE, the routine jumps to step 119, where it is judged if the engine stall flag XNE has been reset or not. When the engine stalls during engine idling, the engine stall flag XNE is set, so at this time the routine proceeds to step 116, where the duty ratio DPG and the purge rate PGR are made zero. Therefore, at this time, the purge action is not yet started.

Next, when it is judged at step 117 that NE>KNE, the routine proceeds to step 118, where the engine stall flag XNE is reset. If the engine stall flag XNE is reset, the routine proceeds from step 119 to step 120, where the current purge rate PGR is made PGR0 and the current duty ratio DPG is made DPG0. Next, the routine proceeds to step 121. At this time, the duty ratio DPG becomes a small value, therefore the purge action is started. Next, the purge rate PGR is gradually increased.

On the other hand, if the engine stalls when the engine is not idling, as explained above, the routine jumps from step 113 to step 116, so the engine stall flag XNE is not set and PGR0 and DPG0 do not become zero. Next, when the engine is restarted, the purge rate PGR0 at the time when the engine stalled is made the restart purge rate PGR at step 106. Further, at this time, the engine stall flag is reset, so the routine proceeds from step 119 to step 120. Therefore, if the engine stalls when the engine is not idling, the purge action is restarted by the purge rate PGR0 of the time when the engine had stalled.

At step 121, processing is performed to drive the purge control valve 17. This drive processing is shown in FIG. 8, therefore, an explanation will next be made of the drive processing of FIG. 8.

Figure 8:
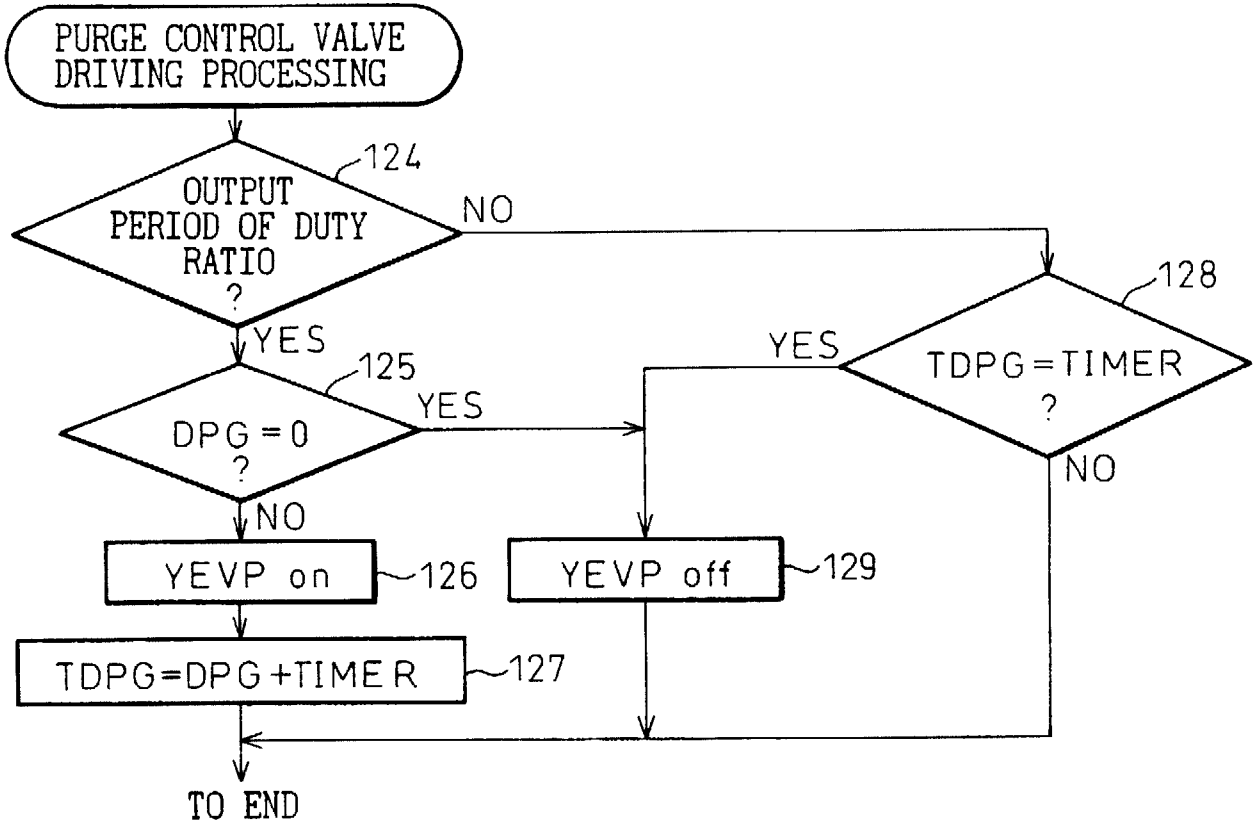
FIG. 8 is a flow chart for the processing for driving the purge control valve.

Referring to FIG. 8, first, at step 124, it is judged if the output period of the duty ratio, that is, the rising period of the drive pulse of the purge control valve 17, has arrived or not. The output period of the duty ratio is 100 msec. If the output period of the duty ratio has arrived, the routine proceeds to step 125, where it is judged if the duty ratio DPG is zero or not. When DPG=0, the routine proceeds to step 129, where the drive pulse YEVP of the purge control valve 17 is turned off. As opposed to this, when DPG is not 0, the routine proceeds to step 126, where the drive pulse YEVP of the purge control valve 17 is turned on. Next, at step 127, the duty ratio DPG is added to the current time TIMER to calculate the off time TDPG of the drive pulse (=DPG+TIMER).

On the other hand, when it is judged at step 124 that the output period of the duty ratio has not arrived, the routine proceeds to step 128, where it is judged if the current time TIMER is the off time TDPG of the drive pulse. When TDPG=TIMER, the routine proceeds to step 129, where the drive pulse YEVP is turned off.

Figure 9:
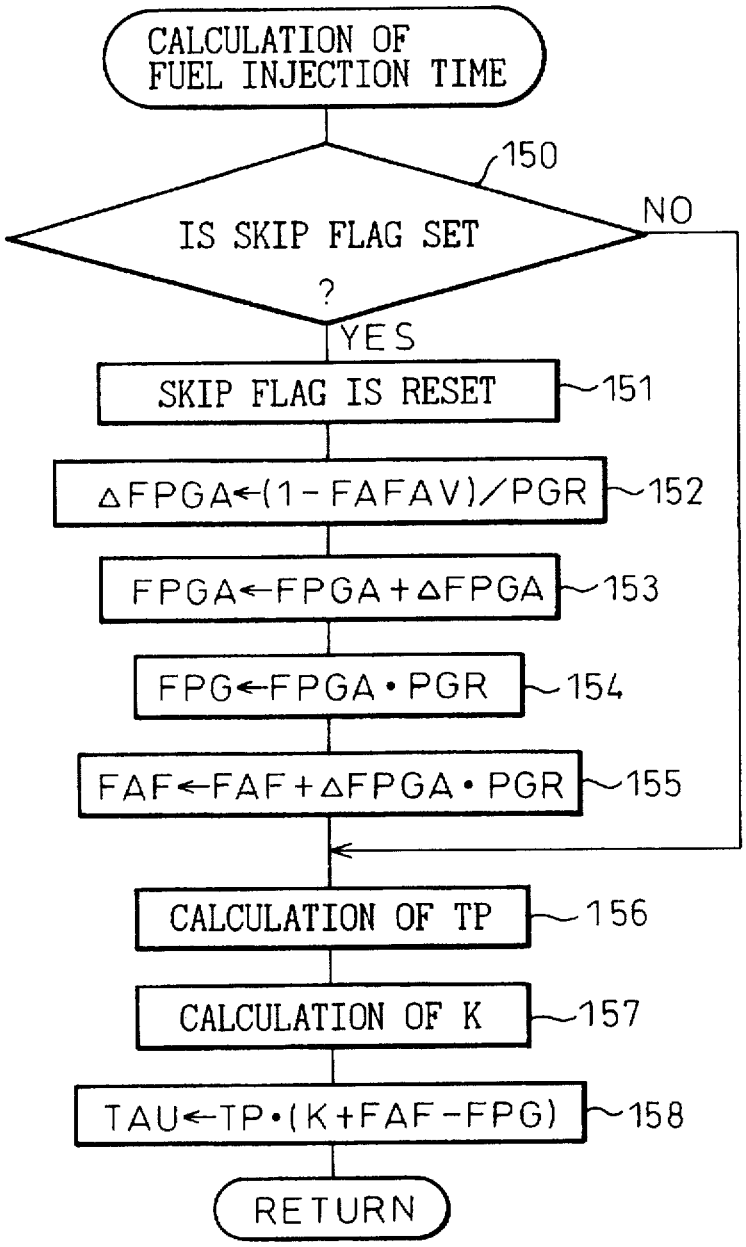
FIG. 9 is a flow chart of the calculation of the fuel injection time.

FIG. 9 shows the routine for calculation of the fuel injection time TAU. This routine is executed repeatedly.

Referring to FIG. 9, first, at step 150, it is judged if the skip flag which is set at step 45 of FIG. 2 has been set or not. When the skip flag has not been set, the routine jumps to step 156. As opposed to this, when the skip flag has been set, the routine proceeds to step 151, where the skip flag is reset, then the routine proceeds to step 152, where the purge vapor concentration ΔFPGA per unit purge rate is calculated based on the following formula:

$$\Delta FPGA=(1-FAFAV)/PGR$$

That is, the amount of fluctuation (1−FAFAV) of the average air-fuel ratio FAFAV shows the purge vapor concentration therefore by dividing (1−FAFAV) by the purge rate PGR, the purge vapor concentration ΔFPGA per unit purge rate is calculated. Next, at step 153, the purge vapor concentration ΔFPGA is added to the purge vapor concentration FPGA to update the purge vapor concentration FPGA per unit purge rate. When FAFAV approaches 1.0, ΔFPGA approaches zero, therefore FPGA approaches a constant value. Next, at step 154, the purge rate PGR is multiplied with FPGA to calculate the purge A/F correction coefficient FPG(=FPGA·PGR). Next, at step 155, ΔFPGA·PGR is added to FAF so as to increase the feedback control coefficient FAF by exactly the amount of the increase of the purge A/F correction coefficient FPG. Next, at step 156, the basic fuel injection time TP is calculated, then at step 157, the correction coefficient K is calculated, then at step 158, the injection time TAU(=TP·(k+FAF=FPG)) is calculated.

Figure 10:
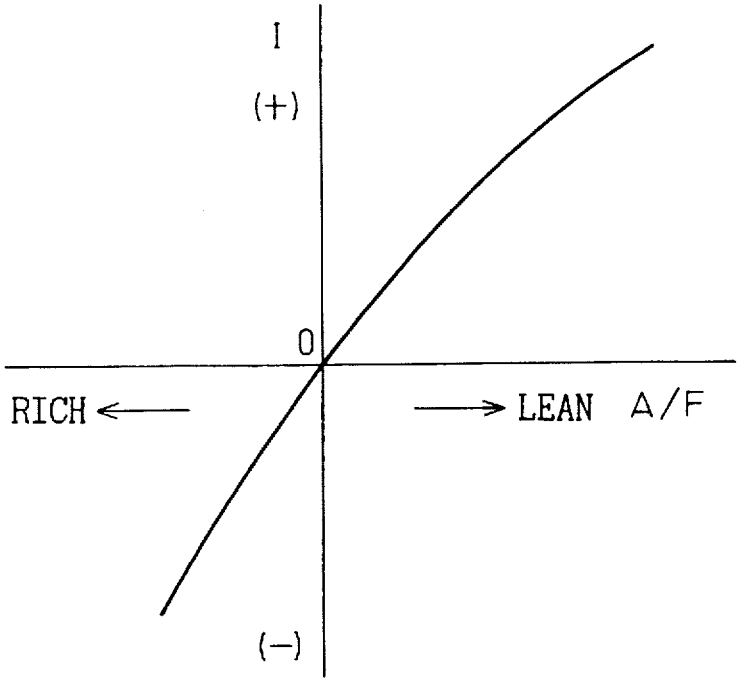
FIG. 10 is a view of the relationship between the current I occurring in the A/F sensor and the air-fuel ratio A/F.

A second embodiment is shown in FIG. 10 to FIG. 13. In this embodiment, as shown in FIG. 10, an air-fuel ratio sensor generating a current I proportional to the air-fuel ratio (hereinafter referred to as an "A/F sensor") is used as the $O_2$ sensor 31. The current I generated by the A/F sensor 31 is converted to a voltage which is then input through the AD converter 32 to the input port 25.

In this embodiment, the fuel injection time TAU is calculated based on the following equation:

$$TAU=TP\cdot\{\text{stoichiometric air-fuel ratio}/(A/F)_0\}\cdot\{K+FAF-FPG\}$$

Where, $(A/F)_0$ represents the target air-fuel ratio.

Figure 11:
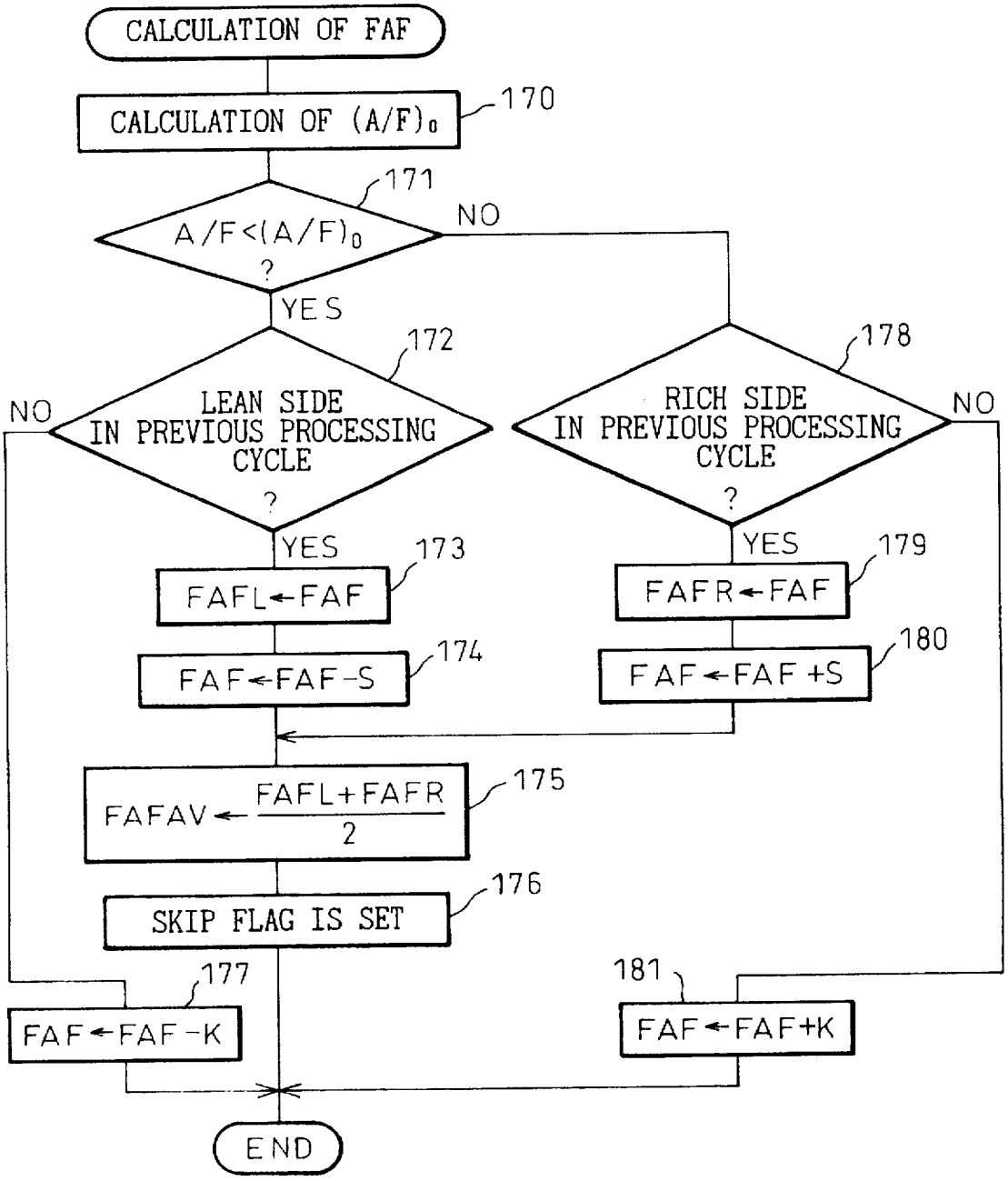
FIG. 11 is a flow chart of the calculation of the air-fuel ratio feedback correction coefficient FAF.

In this embodiment, the feedback correction coefficient FAF is controlled so that the air-fuel ratio becomes the target air-fuel ratio $(A/F)_0$. FIG. 11 shows the routine for calculation of the feedback correction coefficient FAF.

Referring to FIG. 11, first, at step 170, the target air-fuel ratio $(A/F)_0$ is calculated. Next, at step 171, it is judged whether the actual air-fuel ratio A/F detected by the A/F sensor 31 is to the lean side of the target air-fuel ratio $(A/F)_0$ or not. When $A/F<(A/F)_0$, that is, when it is to the rich side of $(A/F)_0$, the routine proceeds to step 172, where it is judged if it was to the lean side at the previous processing cycle. When it was at the lean side in the previous processing cycle, that is, when it changed from the lean side to the rich side, the routine proceeds to step 173, where the feedback control coefficient FAF is made FAFL, then the routine proceeds to step 174. At step 174, a skip value S is subtracted from the feedback control coefficient FAF, therefore the feedback control coefficient FAF is rapidly reduced by the skip value S. Next, at step 175, the average value FAFAV of the FAFL and FAFR is calculated. Next, at step 176, the skip flag is set. On the other hand, when it is judged at step 172 that the air-fuel ratio was rich at the time of the previous processing cycle, the routine proceeds to step 177, where the integral value K (K<<S) is subtracted from the feedback control coefficient FAF. Therefore, the feedback control coefficient FAF is gradually reduced.

On the other hand, when it is judged at step 171 that $A/F\geqq(A/F)_0$, that is, when the actual air-fuel ratio A/F is to the lean side of the target air-fuel ratio $(A/F)_0$, the routine proceeds to step 178, where it is judged if the air-fuel ratio was rich at the time of the previous processing cycle. When it was rich at the time of the previous processing cycle, that is, when it changed from rich to lean, the routine proceeds to step 179, where the feedback control coefficient FAF is made FAFR and the routine proceeds to step 180. At step 180, the skip value S is added to the feedback control coefficient FAF, therefore the feedback control coefficient FAF is rapidly increased by exactly the skip value S. Next, at step 175, the average value FAFAV of FAFL and FAFR is calculated. On the other hand, when it was judged at step 178 that the air-fuel ratio was lean at the time of the previous processing cycle, the routine proceeds to step 181, where the integral value K is added to the feedback control coefficient FAF. Therefore, the feedback control coefficient FAF is gradually increased.

When the air-fuel ratio becomes rich and FAF becomes smaller, the fuel injection time TAU becomes shorter, while when the air-fuel ratio becomes lean and the FAF increases, the fuel injection time TAU becomes longer, so the air-fuel ratio is maintained at the target air-fuel ratio $(A/F)_0$. Note that, in this embodiment as well, when the purge action is not performed, the feedback control coefficient FAF fluctuates about 1.0.

In the second embodiment, when the actual air-fuel ratio detected by the A/F sensor 31 is to the lean side of a predetermined set air-fuel ratio, for example, 10.0, immediately before the engine stalls, it is judged that the engine has stalled due to the purge action of the fuel vapor.

Figure 12:
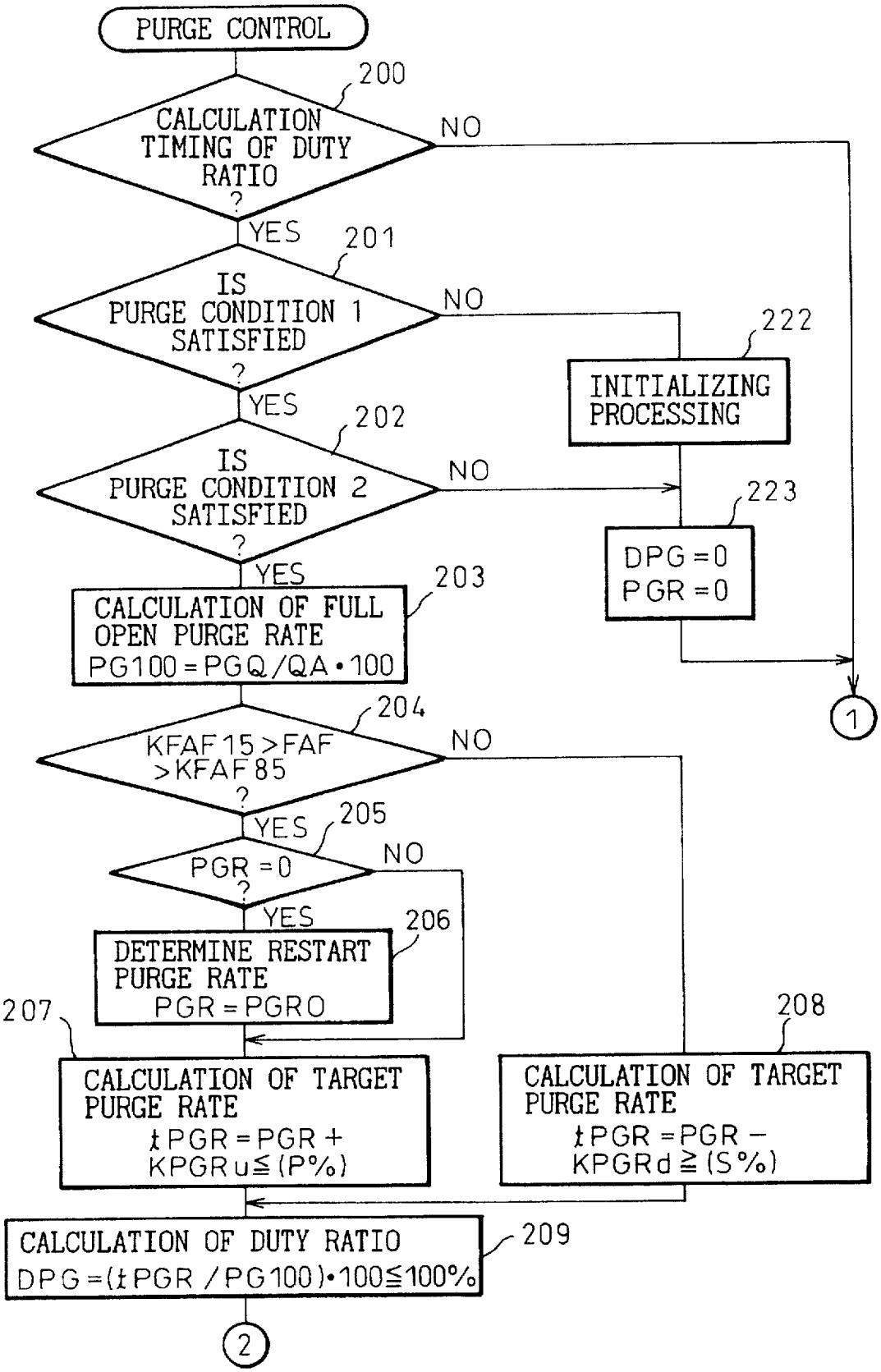
FIGS. 12 and 13 are flow charts of a second embodiment for the purge control.
Figure 13:
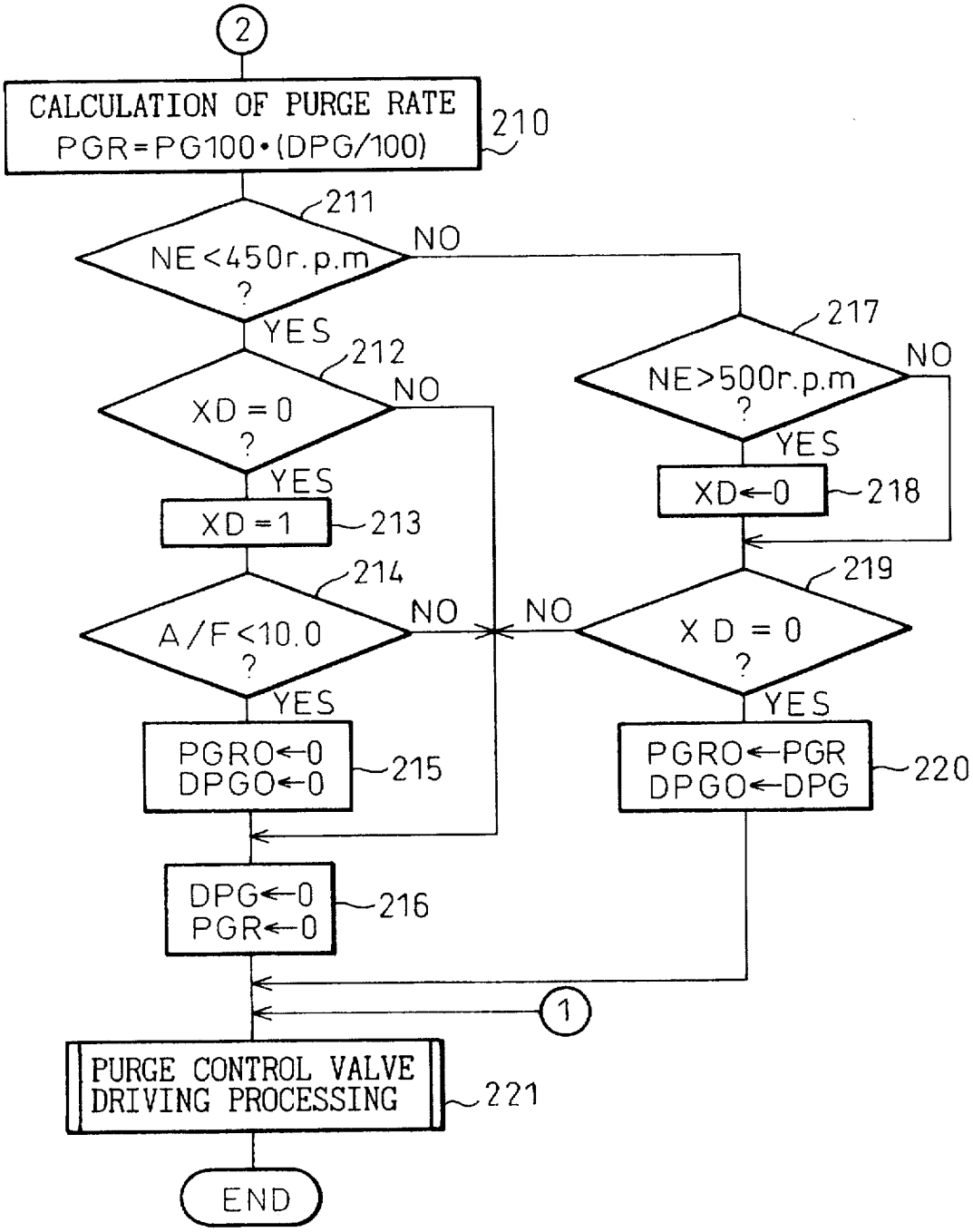

A routine for control of the purge action of the second embodiment is shown in FIG. 12 and FIG. 13.

Referring to FIG. 12 and FIG. 13, first, at step 200, it is judged whether the time is the time of calculation of the duty ratio of the drive pulse of the purge control valve 17 or not. As explained above, in the embodiments according to the present invention, the duty ratio is calculated every 100 msec. When not the time for calculation of the duty ratio, the routine jumps to step 221, where the processing for driving the purge control valve 17 is executed. As opposed to this, when it is the time for calculation of the duty ratio, the routine proceeds to step 201, where it is judged if the purge condition 1 is satisfied or not, for example, if the engine warmup has been completed or not. When the purge condition 1 is not satisfied, the routine proceeds to step 222, where the initialization processing is performed, then at step 223, the duty ratio DPG and the purge rate PGR are made zero. As opposed to this, when the purge condition 1 is satisfied, the routine proceeds to step 202, where it is judged if the purge condition 2 is satisfied or not, for example, whether feedback control of the air-fuel ratio is being performed or not. When the purge condition 2 is not satisfied, for example, when the air-fuel ratio is not being feedback controlled due to the supply of fuel being stopped, the routine proceeds to step 223, while when the purge condition 2 is satisfied, the routine proceeds to step 203.

At step 203, the ratio between the full open purge amount PGQ and the amount QA of intake air, that is, the full open purge rate PG100(=(PGQ/QA)·100) is calculated. Next, at step 204, it is judged if the feedback control coefficient FAF is between the upper limit value KFAF15(=1.15) and the lower limit value KFAF85(=0.85) or not. When KFAF15>FAF>KFAF85, that is, when the air-fuel ratio is being feedback controlled to the target air-fuel ratio $(A/F)_O$, the routine proceeds to step 205, where it is judged whether the purge rate PGR is zero or not. That is, when the purge action is being performed, PGR>0, so at this time the routine jumps to step 207. As opposed to this, when the purge action is not being performed, the routine proceeds to step 206, where PGR0 is made the restart purge rate PGR, then the routine proceeds to step 207.

At step 207, the constant value KPGRu is added to the purge rate PGR to calculate the target purge rate tPGR(=PGR+KPGRu), then the routine proceeds to step 209. On the other hand, when it is judged at step 204 that FAF≧KFAF15 or FAF≦KFAF85, the routine proceeds to step 208, where the constant value KPGRd is subtracted from the purge rate PGR to calculate the target purge rate tPGR(=PGR−KPGRd). Next, the routine proceeds to step 209.

At step 209, the target purge rate tPGR is divided by the full open purge rate PG100 to calculate the duty ratio DPG(=(tPGR/PG100)·100) of the drive pulse of the purge control valve 17. Next, at step 210, the duty ratio DPG is multiplied with the full open purge rate PG100 to calculate the actual purge rate PGR(=PG100·(DPG/100)).

Next, at step 211 to step 220, the purge control for when the engine stalls due to the purge action of the fuel vapor is performed. That is, at step 211, it is judged if the engine speed NE has become less than 450 rpm or not, that is, if the engine is just about to stall. When NE<450 rpm, that is, when the engine is just about to stall, the routine proceeds to step 212, where it is judged if a judgement completion flag XD showing the completion of the judgement as to if the engine stalled due to the purge action is reset (XD=0) or not. When the routine proceeds to step 212 the first time after NE<450 rpm, the judgement completion flag XD is reset, so the routine proceeds to step 213.

At step 213, the judgement completion flag XD is set (XD=1), then at step 214 it is judged based on the output signal of the A/F sensor 31 if the air-fuel ratio A/F has become less than 10.0 or not. When A/F≧10.0, it is judged that the engine did not stall due to the purge action of the fuel vapor. The routine then proceeds to step 216, where the duty ratio DPG is made zero and the purge rate PGR is made zero.

On the other hand, when it is judged at step 214 that A/F<10.0, that is, when it is judged that the engine has stalled due to the purge action of the fuel vapor, the routine proceeds to step 215, where PGR0 and DPG0 are made zero. Next, the routine proceeds to step 216. If the judgement completion flag XD is set once, the routine jumps from step 212 to step 216.

If the engine is restarted after it has stalled, the purge action is stopped at that time, that is, it is judged at step 205 that PGR=0, so the routine proceeds to step 206, where PGR0 is made the restart purge rate PGR. When the engine stalls due to the purge action of the fuel vapor, PGR0=0 as mentioned above, therefore the restart purge rate PGR is made zero at this time.

On the other hand, when the engine is restarted, the routine proceeds from step 211 to step 217, where it is judged if the engine speed NE has become higher than 500 rpm or not. When NE<500 rpm, the routine jumps to step 219, where it is judged if the judgement completion flag XD is reset or not. Since the judgement completion flag XD is set at this time, the routine proceeds to step 216, where the duty ratio DPG and the purge rate PGR are made zero. Therefore, at this time, the purge action is not yet started.

Next, when it is judged at step 217 that NE>500 rpm, the routine proceeds to step 218, where the judgement completion flag XD is reset. When the judgement completion flag XD is reset, the routine proceeds from step 219 to step 220, where the current purge rate PGR is made PGR0 and the current duty ratio DPG is made DPG0. Next, the routine proceeds to step 221. At this time, the duty ratio DPG becomes a small value and therefore the purge action is started. Next, the purge rate PGR is gradually increased.

One the other hand, when the engine stalls due to a reason other than the purge action of the fuel vapor, as mentioned earlier, since the routine jumps from step 214 to step 216, PGR0 and DPR0 do not become zero. Therefore, at this time, the purge action is restarted by the purge rate PGR0 of the time when the engine had stalled. Note that at step 221, processing is performed to drive the purge control valve 17 as shown in FIG. 8.

As mentioned above, according to the present invention, it is possible to prevent the engine from stalling again when restarting the engine after stalling.

While the invention has been described by reference to specific embodiments chosen for purposes of illustration, it should be apparent that numerous modifications could be made thereto by those skilled in the art without departing from the basic concept and scope of the invention.

I claim:

1. An evaporated fuel treatment device for an engine provided with an intake passage, comprising:

a purge control valve for controlling an amount of purge of fuel vapor to be purged to the intake passage;

purge control means for controlling the amount of opening of the purge control valve so that a purge rate of fuel vapor to the intake passage becomes a target purge rate determined by the operating state of the engine; and judging means for judging if the engine has stalled due to the purge action of the fuel vapor, said purge control means restarting the purge action by a purge rate lower than the purge rate at the time when the engine stalled when restarting the engine after it is judged that the engine has stalled due to the purge action of fuel vapor.

2. An evaporated fuel treatment device as set forth in claim 1, wherein said purge control means gradually increases the purge rate from zero when the engine is restarted after it is judged that the engine stalled due to the purge action of the fuel vapor.

3. An evaporated fuel treatment device as set forth in claim 1, wherein said purge control means makes the purge rate the purge rate of the time when the engine stalled when the engine is restarted after it is judged that the engine stalled due to a reason other than the purge action of the fuel vapor.

4. An evaporated fuel treatment device as set forth in claim 1, wherein said purge control means restarts the purge action after the engine speed exceeds a predetermined speed when the engine is restarted after it is judged that the engine stalled due to the purge action of the fuel vapor, and said purge control means restarts the purge action immediately when the engine is restarted after it is judged that the engine stalled due to a reason other than the purge action of the fuel vapor.

5. An evaporated fuel treatment device as set forth in claim 1, wherein said judgement means judges that the engine stalled due to the purge action of the fuel vapor when the engine stalled while the engine load was lower than a predetermined level.

6. An evaporated fuel treatment device as set forth in claim 1, wherein said judgement means judges that the engine stalled due to the purge action of the fuel vapor when the engine speed became zero at the time of idling.

7. An evaporated fuel treatment device as set forth in claim 1, wherein air-fuel ratio detecting means is provided for detecting an air-fuel ratio and said judgement means judges that the engine has stalled due to the purge action of the fuel vapor when the air-fuel ratio just before the engine stalled is smaller than a predetermined air-fuel ratio.

8. An evaporated fuel treatment device as set forth in claim 7, wherein said judgement means judges that the engine stalled due to the purge action of the fuel vapor when the engine speed was lower than a predetermined speed and the air-fuel ratio was lower than a predetermined air-fuel ratio.

9. An evaporated fuel treatment device as set forth in claim 7, wherein the predetermined air-fuel ratio is a rich air-fuel ratio.

10. An evaporated fuel treatment device as set forth in claim 1, comprising air-fuel ratio detecting means for detecting an air-fuel ratio, feedback control means for feedback control of the air-fuel ratio to a target air-fuel ratio, purge vapor concentration calculating means for calculating a concentration of the purge vapor based on the amount of change of the air-fuel ratio, and correcting means for correcting the amount of fuel supplied to the engine by the concentration of the purge vapor calculated by the purge vapor concentration calculating means.

11. An evaporated fuel treatment device as set forth in claim 10, wherein the feedback control means controls the air-fuel ratio to the target air-fuel ratio by correcting the amount of fuel supplied by a feedback correction coefficient which changes in accordance with the air-fuel ratio detected by the air-fuel ratio detecting means, the feedback correction coefficient fluctuates about a predetermined reference value when the air-fuel ratio is maintained at the target air-fuel ratio, and said purge vapor concentration calculation means increases the concentration of the purge vapor when the feedback correction coefficient becomes smaller than said reference value and decreases the concentration of the purge vapor when the feedback correction coefficient becomes larger than said reference value.

12. An evaporated fuel treatment device as set forth in claim 10, wherein said correction coefficient corrects the amount of fuel supplied so that the amount of fuel supplied becomes smaller the higher the concentration of the purge vapor.

13. An evaporated fuel treatment device as set forth in claim 1, wherein means is provided for finding a full open purge rate of the time when the purge control valve is fully open and the amount of opening of the purge control valve is calculated by dividing the target purge rate by the full open purge rate.

* * * * *

UNITED STATES PATENT AND TRADEMARK OFFICE

CERTIFICATE OF CORRECTION

PATENT NO. : 5,782,218
DATED : July 21, 1998
INVENTOR(S) : Akinori OSANAI

It is certified that error appears in the above-identified patent and that said Letters Patent is hereby corrected as shown below:

On the title page item [75], change "Osanai Akinori" to --Akinori Osanai--.

Signed and Sealed this

Fourteenth Day of September, 1999

*Attest:*

Q. TODD DICKINSON

*Attesting Officer*

*Acting Commissioner of Patents and Trademarks*